United States Patent [19]

Suganuma

[11] Patent Number: 4,977,061

[45] Date of Patent: Dec. 11, 1990

[54] PICTURE CARD AND METHOD OF MAKING THE SAME

[75] Inventor: Yoshimi Suganuma, Tokyo, Japan

[73] Assignee: Fuji Photo Film Co., Ltd., Kanagawa, Japan

[21] Appl. No.: 395,674

[22] Filed: Aug. 18, 1989

[30] Foreign Application Priority Data

Aug. 19, 1988 [JP] Japan ..... 63-205961
Aug. 19, 1988 [JP] Japan ..... 63-205962

[51] Int. Cl.[5] ..... G03C 5/54; G03C 11/12

[52] U.S. Cl. ..... 430/203; 430/11; 430/14; 430/237; 430/256

[58] Field of Search ..... 430/203, 237, 256, 11, 430/14

[56] References Cited

U.S. PATENT DOCUMENTS 4,033,770 7/1977 DeHaes et al. ..... 430/256
4,407,932 10/1983 Loder et al. ..... 430/256
4,419,436 12/1983 Kranser ..... 430/256
4,500,626 2/1985 Naito et al. ..... 430/203

FOREIGN PATENT DOCUMENTS 60-3755 1/1985 Japan .

*Primary Examiner*—Richard L. Schilling
*Attorney, Agent, or Firm*—Sughrue, Mion, Zinn, Macpeak & Seas

[57] ABSTRACT

A card, or a seal, with a picture includes a sheet with an image transferred to an image receiving layer coated on a transparent sheet in a heat-transferring manner, and a sheet-like base material to which the image receiving layer is to be attached with an adhesive layer.

The card or the seal is made by a method which includes the steps of forming a mirror image of an original in the photosensitive layer of a photosensitive material superposing the sheet formed with the image on an image receiving layer of an image receiving sheet so as to superpose the photosensitive layer on and adhere the photosensitive layer to an image receiving layer of the image receiving sheet, and heat-developing and heat transferring the image in the photosensitive layer onto the image receiving layer. Then, photographic material is removed from the image receiving sheet, and the image receiving sheet is put on the sheet-like base material so as to superpose the image receiving layer on and adhere the image receiving layer to the sheet-like base material through an adhesive layer. Finally, the supporting sheet is removed from the image receiving sheet.

15 Claims, 7 Drawing Sheets

PICTURE CARD AND METHOD OF MAKING THE SAME

BACKGROUND OF THE INVENTION

The present invention relates to a method of making photographic picture sheets, and to picture sheets made thereby.

Various kinds of personal cards or cards on the market such as identification cards, bank cards, drivers' licenses, pre-paid cards such as telephone cards or oil company cards, or the like are commonly used. Some of these cards are essential to prove the card holder's identity, and accordingly are provided with a picture of the face of the card holder. Others of these cards often are provided with various kinds of pictures, illustrations or the like.

Various ways of providing the card with a picture have been known. In Japanese Unexamined Utility Model Publication No. 62-50986, a picture is printed on a solid color pre-paid card with a photosensitive emulsion layer. In Japanese Unexamined Utility Model Publication No. 62-201747, a pre-paid card is made of photographic paper with necessary data, and has a space where a picture is printed.

Otherwise, as is described in Japanese Unexamined Utility Model Publication No. 61-192874, a seal print with a picture is adhered to a solid color card. Seal prints attached to cards, books, notes or the like also are well known. Such seal prints comprise a photographic print applied with an adhesive covered by a separation sheet. After removing the separation sheet, the seal print is easily attached to a card, such as a telephone card, a name card or the like, note books or the like.

One kind of seal print is known, for example, from Japanese Unexamined Utility Model Publication No. 60-3755, and comprises a supporting sheet such as a paper sheet with a peelable resin layer and a photosensitive emulsion layer coated thereon. To make a seal print, after forming an image on the photosensitive emulsion layer, the supporting sheet is removed and, in place of the supporting sheet, an adhesive material with a separation sheet such as a double-faced adhesive tape is provided.

To form an image on a card, or a seal, that is provided with a photosensitive emulsion layer formed on one surface thereof, photographic processes, such as exposing, developing, fixing and drying, which are time-consuming procedures, are needed. Furthermore, the photosensitive emulsion layer, in which an image has been formed, can become discolored by the sunlight and/or water, or become stained, or get scratches. Also, an image formed on the card or the seal print by a heat-transfer printer generally has insufficient definition.

SUMMARY OF THE INVENTION

Therefore, it is one object of the present invention to provide a card with a picture, and a method of making such a card, in which the image surface does not become discolored by the sunlight and/or water, become stained, or get scratches.

It is another object of the present invention to provide a method of making a thin card with a picture in which a developing process is simplified.

The foregoing and other objects of the present invention are achieved by a card with a picture comprising a sheet with an image transferred to a heat-transferring type of image receiving layer coated on a transparent sheet by heat-transferring, and a sheet-like base material to which the heat-transferring type of image receiving layer coated on the transparent sheet is to be attached with an adhesive layer.

According to the method of making the card, or a seal print, with a picture of the present invention, an image of an original is formed in a photosensitive material in a reverse or mirror image exposure. The sheet formed with the original image is put on an image receiving layer of a heat development type of image receiving sheet consisting of a transparent supporting sheet, a peelable transparent sheet attached to the transparent supporting sheet, and an image receiving layer coated on the peelable transparent sheet. The photosensitive layer and the image receiving layer are superposed on the transparent supporting sheet. The original image formed in the photosensitive layer is heat-developed, and the heat-developed image is heat-transferred onto the heat-development type of image receiving layer. The heat development type of image recording photographic material is removed from the heat-development type of image receiving sheet. Then, the heat-development type of image receiving sheet is put on a sheet-like base material so as to superpose and adhere the image receiving layer and the card base through an adhesive layer previously applied to one surface of the sheet-like base material, and the supporting sheet is removed from the heat-development type of image receiving sheet. Finally, margins of the superposed sheet-like base material and the transparent sheet are cut off so as to leave the card, or the seal print, with a picture.

DETAILED DESCRIPTION OF THE PREFERRED EMBODIMENTS

Figure 1:
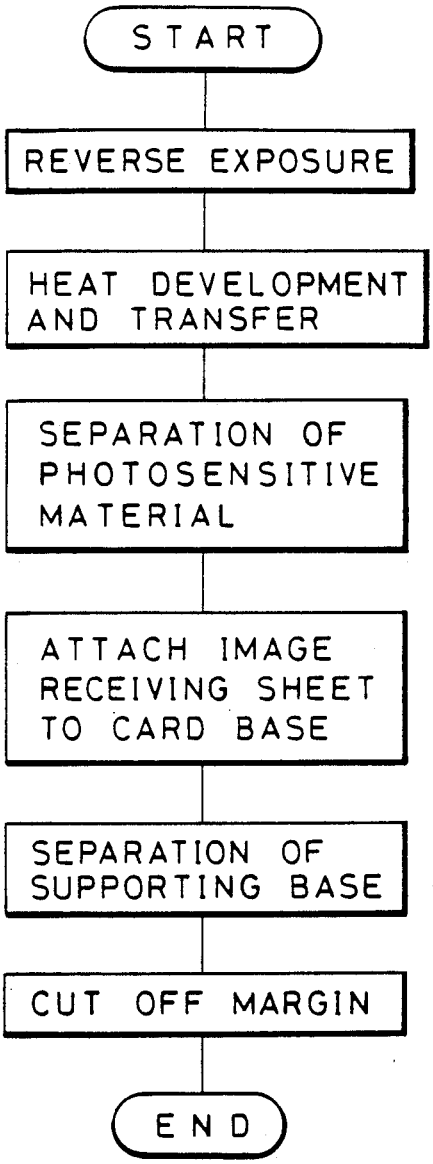
FIG.1 is a flow chart illustrating the sequence of making a card with a picture according to a preferred embodiment of the present invention.

Referring to the drawings, in particular to FIG. 1, the method of making a picture card, such as a pre-paid telephone card, according to a specific embodiment of the present invention is shown, including a step of exposing an image of an heat development type of image recording photographic sheet in a reversal exposure. After putting a print sheet, which consists of a supporting sheet and an image receiving photographic layer separably provided on the supporting sheet, on top of the exposed image recording photographic sheet, heat development is performed so as to develop an image in the image recording photographic sheet and transfer it to the image receiving photographic sheet by heat development and transfer. After separating the image recording photographic sheet from the image receiving sheet, the image receiving photographic sheet is attached to a card base to adhere the image receiving layer to the card base. Finally, the supporting sheet is separated from the image receiving sheet, leaving the card base with the image receiving layer photographic layer as a card with a picture. Margins of the card of the image receiving sheet them are trimmed.

Figure 2:
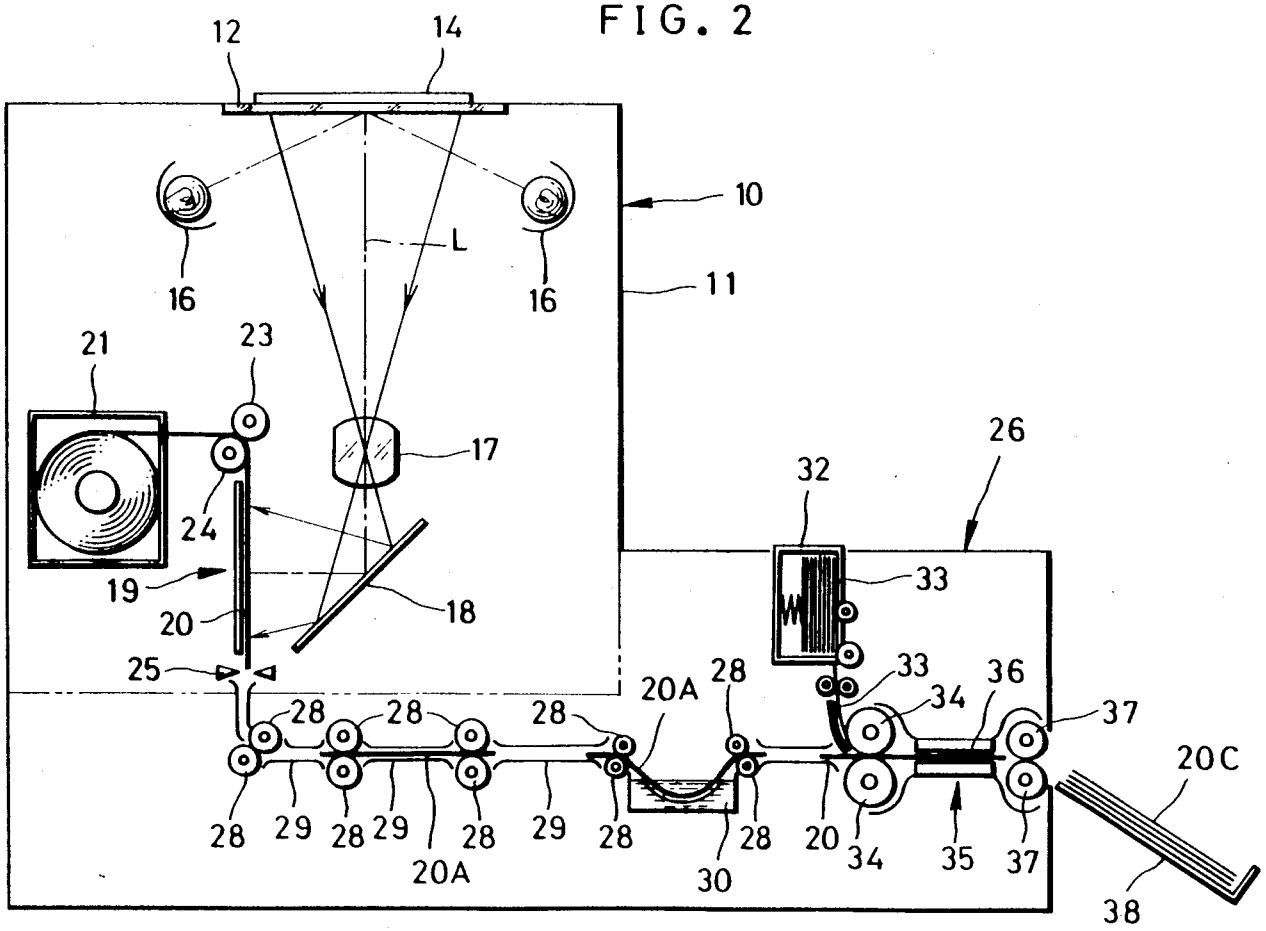
FIG. 2 is a schematic view showing an apparatus for exposure and development.

Referring to FIG. 2, a printing apparatus for performing the method of making the picture card according to the present invention is shown, and generally comprises a reverse exposure apparatus 10 and a heat development and transfer apparatus 26. The reverse exposure apparatus 10 has a housing 11 provided with a table 12 on which a reflective original 14, such as a picture to be printed, is placed. The table 12 comprises a transparent glass plate installed in the tope wall of the housing 11. A pair of lamps 16 are provided below the table 12 on both sides thereof in the housing 11 to illuminate the reflective original 14 on the table 12.

Right below the table 12 a reverse exposure optical system including an optical lens system 17 is so disposed in the housing 11 as to have an optical axis L passing through a center of the table 12 and to project an image of the original 14 placed on the table 12 onto a photosensitive material 20 in an exposure station 19. To form a mirror image of the original 14 in the photosensitive material 20, a reflective mirror 18 of the reverse exposure system is so disposed right below the optical lens system 17 as to turn laterally the optical axis L of the optical lens system 17 at a right angle, thereby directing light passing through the optical lens system 17 toward the photosensitive material 20. The photosensitive material 20 is provided in a roll in a magazine 21 and is withdrawn out of the magazine 21 by means of a pair of drive rollers 23 and 24 driven by a motor (not shown) one frame at a time for every exposure.

In the exposure station 19 the exposed part of the photosensitive material 20 is cut by a cutter 25 to form an exposed photosensitive sheet 20A and is carried by a plurality of pairs of motor driven carrier rollers 28 arranged along a guideway 29 toward the heat developing and transferring apparatus 26.

The exposed photosensitive sheet 20A first is guided into a water application bath 30 to apply a water layer of uniform thickness over a photosensitive layer 40 (see FIG. 3) thereof. This water layer serves as a diffusing subordinator. After the application of the water layer, the exposed photosensitive sheet 20A is passed between a pair of motor driven squeeze rollers 34 which are urged against each other. The squeeze rollers 34 carry the exposed photosensitive sheet 20A, superposing an image receiving sheet 33 fed from a sheet magazine 32 over the exposed photosensitive sheet 20A and removing air from between the superposed sheets 20A and 33, toward a heat developing and transferring station 35. During the passing of the superposed sheets through the heat developing and transferring station 35, a heater 36 heats the superposed sheets 20A and 33 so as to develop an image in the exposed photosensitive sheet 20A and transfer the developed image onto the image receiving sheet 33. Thereafter, the superposed sheets 20A and 33 are ejected as a unit by means of a pair of motor driven rollers 37 into a tray 38. It should be understood that the heat development type of image receiving sheet may be prepared by cutting off a long web of image receiving sheet into single-frame lengths of image receiving sheets.

Figure 3:
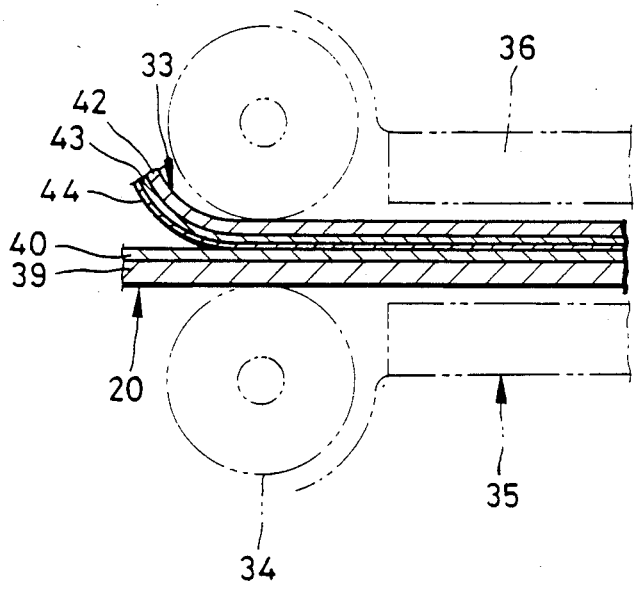
FIG. 3 is a cross-sectional view showing an essential part of the apparatus shown in FIG. 1.

Referring to FIG. 3 showing partly the superposed sheets 20A and 33, the photosensitive sheet 20A comprises a supporting sheet 39 desirably made of a polyethylene terephthalate (PET) sheet and a heat development type photosensitive layer 40 formed on the supporting sheet 39. The photosensitive layer 40 is of a photosensitive element of the heat development type releasing dye such as described in, inter alia, U.S. Pat. No. 4,500,626, and Japanese Unexamined Patent Publication Nos. 60-133449, 59-218443, and 61-238056.

The image receiving sheet 33 consists of a relatively stiff supporting base 42 desirably made of, for example, a polyethylene terephthalate (PET) material sheet, which is flexible, having a thickness of about 100 μm, a transparent sheet 43, such as a polyethylene sheet having a thickness of about 30 μm weakly attached to the supporting sheet 42 and an image receiving layer 44 having a thickness of about 10 μm. The image receiving layer 44 is of a dye fixing material containing mordant material. A typical example of such materials is described in the above mentioned patent and/or publications.

The dye released from the photosensitive layer 40 is transferred to the image receiving layer 44 with the aid of solvent or water. The supporting sheet 42 may be a white polyethylene terephthalate (PET) sheet or a white paper sheet, and the transparent sheet 43 may be a transparent polyethylene terephthalate (PET) sheet.

After having finished development and transfer at the heat developing and transferring station 35, the photosensitive sheet 20A is separated from the image receiving sheet 33, either manually or automatically, by the use of a special separation device (not shown) well known in the art.

Figure 4:
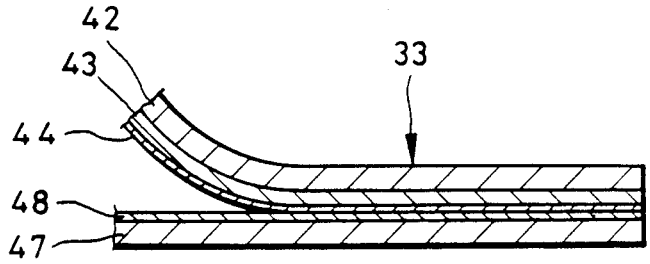
FIG. 4 is an illustration showing a card base and an image receiving sheet superposed.

Referring to FIG. 4 showing a step of attaching the image receiving sheet 33 to a card base 47 which has been separately prepared previously, the card base 47 is provided with an adhesive layer 48 which takes a form of a sheet of hot-melt adhesive material, such as a thermohardening adhesive material, a thermosoftening adhesive material, etc. To adhere the adhesive layer 48, it is first superposed over the image receiving layer 44 of the image receiving sheet 33 and heated by means of a heat roller (not shown). It is desirable to pass through juxtaposed heat rollers so as to force out air bubbles from between the adhesive layer 48 and the image receiving layer 44. The transparency of the supporting sheet 42 makes it possible to verify the relative location of the image formed on the image receiving layer 44 to the card base 47. This makes it possible to print numerals indicating the numbers of calls on the image receiving layer 44, although the numerals should be precisely positioned with respect to the base card 47.

The adhesive layer 48 contains a white pigment (titanium oxide) mixed therein. Because the adhesive layer 48 does not affect transparent color and patterns of a material adhered thereto, the image of the image receiving layer 44 is independent of the color and pattern of a material to which the image receiving layer is adhered, and thus may be viewed clearly through the transparent sheet 43. It is possible to use any type of well known adhesive in place of a hot-melt adhesive. If the surface of the card base 47 is solid white, the adhesive layer 48 may be transparent.

Figure 5:
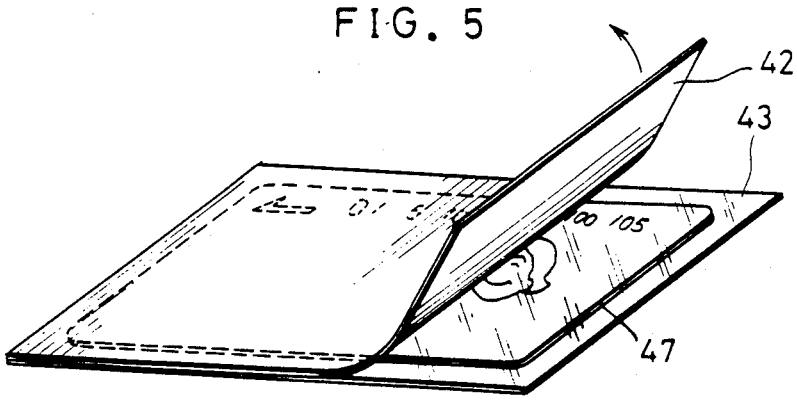
FIG. 5 is a perspective illustration showing a transparent sheet separated from a supporting sheet.

As shown in FIG. 5, the supporting sheet 42 of the image receiving sheet 33 is separated from the transparent sheet 43. This results in making the finished card thin. The image transferred to the image receiving layer 44 from the photosensitive material 20 is viewed as an elected image through the transparent sheet 43.

Figure 6:
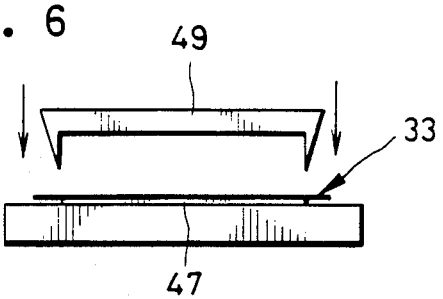
FIG. 6 is a side view of a card before cutting off margins.

Referring to FIG. 6, margins of the image receiving sheet 33 jutting out from the card base 47 are cut off by means of a punching cutter 49. In place of the punching cutter 49, scissors may be used to cut off the margins of the image receiving sheet 33.

For making a card, such as a pre-paid telephone card, and referring again to FIG. 2, a reflective original 14 is placed on the table 12 and an exposure button (not shown) is pushed. As a result, the lamps 16 are energized to illuminate the reflective original 14. A reverse or mirror image of the original 14 is formed on the photosensitive material 20 in the exposure station 19 by means of the reverse exposure system comprising the optical lens system 17 and the mirror 18.

The photosensitive material 20 is withdrawn one frame at a time to place an unexposed part thereof in the exposure station, and the exposed part of the photosensitive material 20 is cut off to an exposed sheet 20A. The exposed sheet 20A is forwarded to the water application bath 30 by the rollers 28 and there applied with an uniform layer of water over the photosensitive layer 40 thereof. Thereafter, the exposed sheet 20A is forwarded toward the squeeze rollers 34. The squeeze rollers 34 grasp the image receiving sheet 33 and the exposed sheet 20A so as to superpose them, bringing the photosensitive layer 40 and the image receiving layer 44 into close contact, and to press and forward them toward the heat developing and transferring station 35. There, the superposed sheets 20A and 33 are subjected to heat developing and transferring and then are delivered as a picture card 20C into the tray 38.

Figure 7:
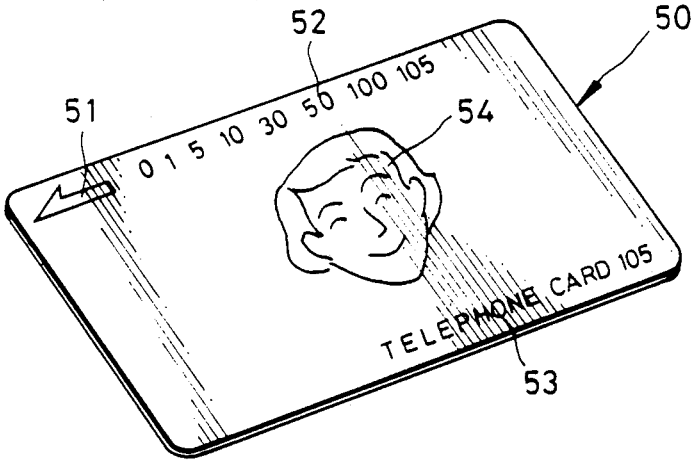
FIG. 7 is a pre-paid telephone card in accordance with a preferred embodiment of the present invention.

The sheet 20A is separated from the picture card 20C. The picture card is adhered to the card base 47, and air is squeezed from between the card and the card base by means of heat rollers. After separating the supporting base 42, margins of the image receiving sheet 33 jutting out from the card base 47 are cut off by the punching cutter 49, leaving a telephone card 50 as shown in FIG. 7.

Various images other than the principal image 54, such as an arrow 51 instructing an insertion direction, a row of FIGS. 52 indicating the numbers of calls and a title 53, which are common to almost of all telephone cards, are transferred to the image receiving sheet 33 together with the principal image 54.

Figure 8:
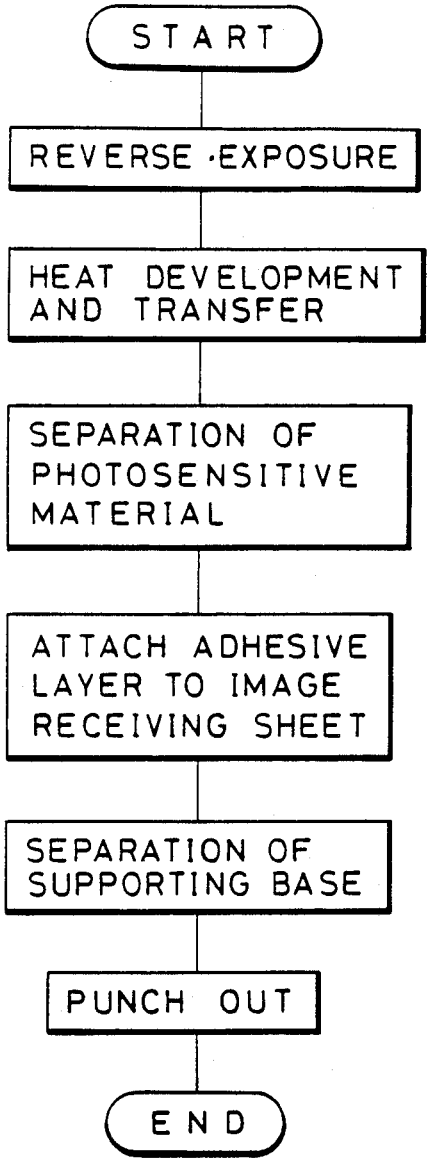
FIG. 8 is a flow chart illustrating the sequence of making a seal print with a picture according to a preferred embodiment of the present invention.

Referring to FIG. 8, the method of making a seal print according to another specific embodiment of the present invention is shown, including a step of exposing an image on a heat development type of photosensitive sheet in a reverse exposure. After putting an image receiving sheet, which consists of a supporting sheet and an image receiving photosensitive layer separably provided on the supporting sheet, on top of the exposed photosensitive sheet, heat development is performed so as to create an image in the photosensitive sheet and transfer the image onto the image receiving photosensitive sheet in a heat development and transfer manner. After removing the photosensitive sheet from the image receiving photosensitive sheet, a double-faced white adhesive material with a separation sheet is attached to image receiving layer of the image receiving photosensitive sheet. Finally, the image receiving photosensitive sheet attached with the double-faced white adhesive material with a separation sheet is punched to provide a seal print. The steps from exposing a heat development type of photosensitive sheet in a reversal exposure to removing the photosensitive sheet from an image receiving photosensitive sheet are the same as in the previous embodiment, and so need not be explained again.

Figure 9:
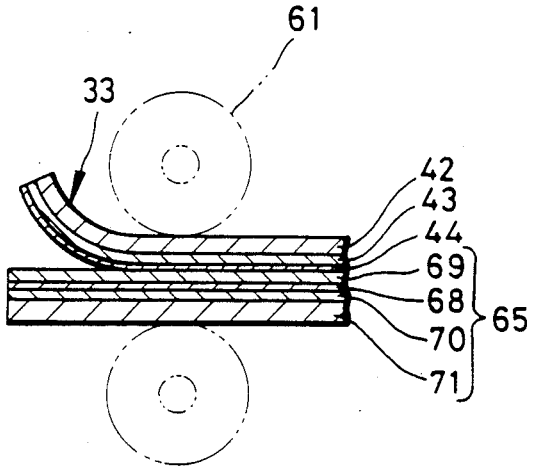
FIG. 9 is an illustration showing a double-faced adhesive material and an image receiving sheet superposed.

Referring now to FIG. 9, the image receiving sheet 33 onto which an image has been transferred is superposed on the double-faced white adhesive material 65 in a form of a sheet. The double-faced white adhesive material 65 comprises an aluminum coated polyethylene terephthalate (PET) sheet 68 with acrylic adhesive layers 69 and 70 coated on both surfaces of the aluminum coated polyethylene terephthalate (PET) sheet 68. The acrylic adhesive layer is formed of an acrylic adhesive material containing a white pigment, such as a titanium oxide, mixed therein. The double-faced white adhesive sheet 65 is further attached with a separation sheet 51 on the side of the acrylic adhesive layer 70. The image receiving sheet 33 is put on top of the double-faced white adhesive sheet 65 to contact the image receiving layer 44 of the image receiving sheet 33 and the acrylic adhesive layer 69, and the superposed sheets 33 and 65 are passed between a pair of squeezing rollers 61 to remove air from between those sheets.

Because the double-faced white adhesive sheet 65 is not transparent, and therefore the color and pattern of a material to which it is adhered cannot be seen, the image transferred onto the image receiving layer 44 is clearly viewed through the transparent sheet 43 without being affected by color and pattern of a material to which it is attached. It may be possible to use a white polyethylene terephthalate (PET) sheet or a white paper sheet, and a transparent adhesive layer in place of the aluminum coated polyethylene terephthalate (PET) sheet 68 and the white acrylic adhesive layers 69 and 70, respectively.

Figure 10:
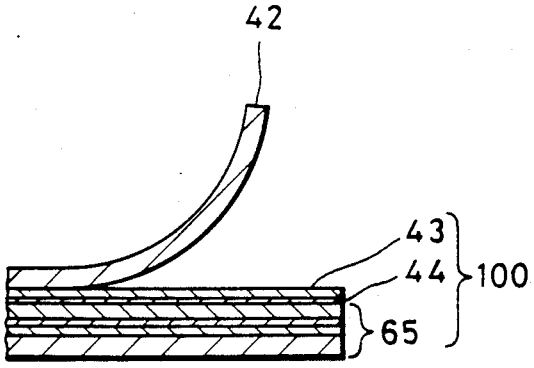
FIG. 10 is a cross-sectional view showing a transparent sheet separated from a supporting sheet.
Figure 11:
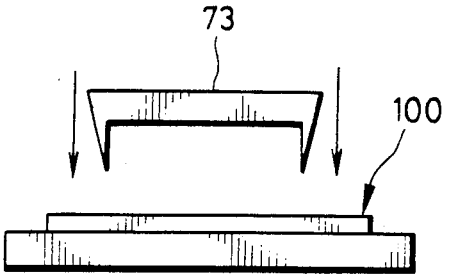
FIG. 11 is a side view of a seal print before being punched out.

Referring to FIG. 10, after superimposing the image receiving sheet 33 and double-faced white adhesive sheet 65, the supporting sheet 42 of the image receiving sheet 33 is separated from the superposed sheets 33 and 65, leaving a thin seal print sheet 100. The image transferred onto the image receiving layer 44 is viewed as an elected image through the transparent sheet 43.

Figure 12:
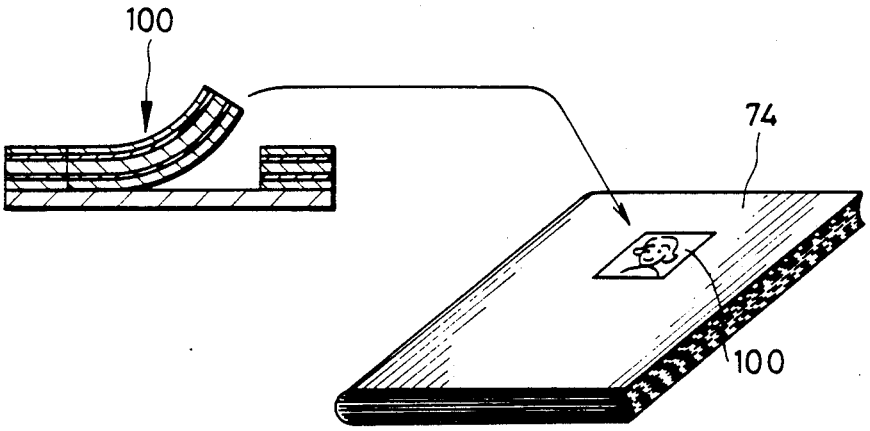
FIG. 12 is an illustration showing an application of the seal print.

As shown in FIG. 1!, the seal print sheet 100 is formed with cut lines by a punch out cutter 73 so as to provide a predetermined size of seal prints 100A. To prevent the seal prints 100A from being separated, the punch out cutter 73 is regulated in penetrating depth so as not to cut the separation sheet 71. Each seal print 100A is detached from the separation sheet 71 and attached to a note book 74, or something else such as a telephone card, as shown in FIG. 12.

Figure 13:
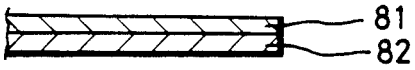
FIG. 13 is a variant of the double-faced adhesive material shown in FIG. 9.

Referring to FIG. 13, a variant of the double-faced white adhesive sheet 65 is shown, comprising a separation sheet 82 and an acrylic adhesive layer 81 containing a white pigment, such as a titanium oxide, mixed therein coated on one surface of the separation sheet 82.

Although the present invention has been fully described by way of the preferred embodiment thereof with reference to the accompanying drawings, various changes and modifications will be apparent to those of working skill in this technical field. Therefore, unless otherwise these changes and modifications depart from the scope of the present invention as defined by the appended claims, they should be construed as included therein.

What is claimed is:

1. A method of making a picture sheet, comprising the following steps:

(i) forming a mirror image of an original in a photosensitive layer of a heat development type of photosensitive material;

(ii) putting an image receiving layer of a heat development type of image receiving sheet on said heat development type of photosensitive material so as to superpose said photosensitive layer on and adhere said photosensitive layer to said image receiving layer, said image receiving sheet comprising a supporting sheet, a peelable transparent sheet attached to said supporting sheet, and an image receiving layer coated on said peelable transparent sheet;

(iii) heat-developing and heat-transferring said image formed in said photosensitive layer onto said heat development type of image receiving sheet;

(iv) removing said heat development type of photosensitive material from said heat development type of image receiving sheet;

(v) putting said heat development type of image receiving sheet on a sheet of base material so as to superpose said image receiving layer on and adhere said image receiving layer to said sheet of base material through an adhesive layer previously applied to said sheet of base material; and (vi) removing said sheet of base material from said heat development type of image receiving sheet.

2. A method as defined in claim 1, wherein said sheet of base material comprises a card.

3. A method as defined in claim 1, wherein said sheet of base material comprises a double-faced white adhesive sheet with adhesive layers formed thereon.

4. A method as defined in claim 1, wherein said sheet base material comprise polyethylene terephtalate film with an aluminum layer coated on each surface thereof.

5. A method of making a card with a picture, comprising the following steps:

(i) forming a reverse exposure image of an original in a photosensitive layer of a heat development type of photosensitive material;

(ii) putting an image receiving layer of a heat development type of image receiving sheet comprising a transparent supporting sheet, a peelable transparent sheet attached to said transparent supporting sheet, and an image receiving layer coated on said peelable transparent sheet, on said heat development type of photographic material so as to superpose said photosensitive layer on and adhere said photosensitive layer to said image receiving layer;

(iii) heat-developing and heat-transferring said image formed in said photosensitive layer onto said heat-development type of image receiving layer;

(iv) removing said heat development type of photographic material from said heat-development type of image receiving sheet;

(v) putting said heat-development type of image receiving sheet on a card so as to superpose and adhere said image receiving layer and said card through an adhesive layer previously applied to on e surface of said card;

(vi) removing said supporting sheet from said heat-development type of image receiving sheet; and (vii) cutting margins of said superposed card and said transparent sheet so as to trim said card, whereby leaving said card with a picture.

6. A method as defined in claim 5, wherein said heat development type of photosensitive material comprises a roll of said photosensitive material which is withdrawn one frame at a time for exposure.

7. A method as defined in claim 6, wherein said heat development type of photosensitive material is cut into photosensitive sheets having substantially the same size as said heat development type of image receiving sheet.

8. A method as defined in claim 7, further comprising the step of applying a substantially uniform layer of water to a surface of each of said photosensitive sheets before superposing each of said photosensitive sheets over said heat-development type of image receiving sheet.

9. A method as defined in claim 8, wherein each of said photosensitive sheets is superposed over said heat development type of image receiving sheet so as to squeeze air and water from between each of said photosensitive sheets and said heat development type of image receiving sheet.

10. A method of making a seal print, comprising the following steps:

(i) forming a reverse exposure image of an original in a photosensitive layer of a heat development type of photosensitive material;

(ii) putting an image receiving layer of a heat development type of image receiving sheet comprising a transparent supporting sheet, a peelable transparent sheet attached to said transparent supporting sheet and an image receiving layer coated on said peelable transparent sheet, on said heat development type of image recording photographic material so as to superpose said photosensitive layer on and adhere said photosensitive layer to said image receiving layer;

(iii) heat-developing and heat-transferring said image formed in said photosensitive layer onto said heat-development type of image receiving layer;

(iv) removing said heat development type of image recording photographic material from said heat-development type of image receiving sheet;

(v) putting said heat-development type of image receiving sheet on one adhesive layer of a double-faced white adhesive sheet with a separation sheet attached to the other adhesive layer so as to superpose said image receiving layer on and adhere said image receiving layer to said double-faced white adhesive sheet;

(vi) removing said supporting sheet from said heat-development type of image receiving sheet; and (vii) cutting said superposed said heat-development type of image receiving sheet and said double-faced white adhesive sheet to a desired size, so as to produce said seal print.

11. A method as defined in claim 10, wherein said heat development type of photosensitive material comprises a roll of said photosensitive material which is withdrawn one frame at a time for exposure.

12. A method as defined in claim 10, wherein said step (ii) comprises providing a roll of said heat development type of image receiving sheet, cut into individual lengths of a single frame.

13. A method as defined in claim 11, wherein said heat development type of photosensitive material is cut into a photosensitive sheet having substantially the same size as said heat-development type of image receiving sheet.

14. A method as defined in claim 13, further comprising the step of applying a substantially uniform layer of water to a surface of said photosensitive sheet before superposing said photosensitive sheet over said heat-development type of image receiving sheet.

15. A method as defined in claim 14, wherein said photosensitive sheet is superposed over said heat development type of image receiving sheet so as to squeeze air and water from between said photosensitive sheet and said heat development type of image receiving sheet.

* * * * *